2/11/86 OR 4,569,750

United States Patent [19]

Brownawell et al.

[11] Patent Number: 4,569,750

[45] Date of Patent: Feb. 11, 1986

[54] METHOD FOR INHIBITING DEPOSIT FORMATION IN STRUCTURES CONFINING HYDROCARBON FLUIDS

[75] Inventors: Darrell W. Brownawell, Scotch Plains; Antonio Gutierrez, Mercerville; Stanley J. Brois, Westfield; Donald F. Jacques, Belle Mead, all of N.J.; Gary L. Behelfer; Thomas M. Ferrell, both of Houston, Tex.; Stephan Ilnyckyj, Mississauga, Canada

[73] Assignee: Exxon Research & Engineering Co., Florham Park, N.J.

[21] Appl. No.: 675,372

[22] Filed: Nov. 27, 1984

[51] Int. Cl.[4] ..... C10G 9/12; C10G 9/16

[52] U.S. Cl. ..... 208/48 AA; 252/51.5 A; 585/950

[58] Field of Search ..... 208/48 AA, 48 R; 252/401, 403, 405, 151.3 R, 51.5 A; 585/950

[56] References Cited

U.S. PATENT DOCUMENTS

| | | | |
|---|---|---|---|
| 4,001,212 | 1/1977 | Richman | 260/239 BC |
| 4,090,946 | 5/1978 | Nottes et al. | 208/48 AA |
| 4,277,354 | 7/1981 | Brois et al. | 252/51.5 R |
| 4,283,296 | 8/1981 | Nebzydoski et al. | 252/51.5 R |
| 4,396,735 | 8/1983 | Minagawa et al. | 252/405 |
| 4,431,514 | 2/1984 | Ferm | 252/51.5 A |
| 4,482,464 | 11/1984 | Karol et al. | 252/51.5 A |

*Primary Examiner*—D. E. Gantz
*Assistant Examiner*—Anthony McFarlane
*Attorney, Agent, or Firm*—B. C. Cadenhead

[57] ABSTRACT

Deposit formation on the interior surfaces of structures confining heated hydrocarbon fluids such as refinery units, particularly preheating stages associated with process units such as distillation units, hydrotreaters and thermal crackers, is inhibited by incorporating in the feed stock a small percentage (usually at least about 0.0005 weight percent) of a macrocyclic polyamine formed by cyclodehydration of reaction products of hydrocarbon substituted succinic anhydrides or carboxylic acids with poly 3-amino propyl compounds or by acylation of macrocyclic polyamine and polycyclic polyamines with hydrocarbon substituted succinic anhydride or carboxylic acids. It is desirable in some instances to dissolve additionally in the hydrocarbon fluid such as a feed stock along with the macrocyclic polyamine an oil-soluble dispersant, antioxidant and mixtures thereof.

11 Claims, No Drawings

METHOD FOR INHIBITING DEPOSIT FORMATION IN STRUCTURES CONFINING HYDROCARBON FLUIDS

The present invention relates to improvements in antifoulant processes in vessels confining heated hydrocarbon fluids such as liquid petroleum hydrocarbons. In a more particular sense, it relates to a method for inhibiting the accumulation of harmful carbonaceous material in refinery preheating stages and cracking units.

BACKGROUND OF THE INVENTION

The production of refinery products such as the various oil fractions, fuels and solvents involve the preheating of crude oils to from 150° C. to 350° C. prior to distillation into various fractions and followed by subsequent exposure of some fractions to higher temperatures of 350° C. to 700° C. As an illustration most of the gasoline produced today is obtained by the thermal or catalytic cracking of heavier petroleum hydrocarbon feed stocks such as light or heavy gas oils, cycle stocks, virgin or topped crude oils, lube stocks, kerosene, and kerosene-gas oil mixtures. A number of different thermal and/or catalytic cracking processes known in the petroleum industry under designations such as Fluid Process, Thermofor, Houdry, Platforming, Thermal Reforming, Viscosity-Breaking, etc., are employed for the purpose. Although these various processes differ considerably as to the precise manner in which the heavier hydrocarbon molecules are cracked to yield gasoline, they all involve the heating of the hydrocarbon feed stock to a high temperature (150°-370° C.) and the passage of such heated stock, optionally mixed with a cracking catalyst, through heated tubes, reactors, convertors, and tower stills.

Regardless of the refinery process used, the distillation and/or cracking operation (particularly the former) always results in the formation of undesirable carbonaceous material which accumulates on the inner surfaces of the preheating and/or cracking unit to lower its efficiency at which time the unit must be dismantled, cleaned, and reassembled. Of course, such cleaning operations are not only tedious and costly, but result in a large proportion of "down-time" during which the unit is not functioning. One approach to antifoulant processes is set forth in U.S. Re. No. 26,330 wherein deposit formation in refinery units is inhibited by incorporating in the feed stock a small percentage (usually about 0.0012-0.04 weight percent) of an acylated amine prepared by reacting a hydrocarbon-substituted succinic acid with an alkylene amine.

Another approach to the prevention of fouling of process equipment by an oil stream in refinery operations is to incorporate in the feed 0.001 to 2 wt. % of a bis-oxazoline reaction product of polyisobutenylsuccinic anhydride with a 2,2 disubstituted-2-amino-1-alkanol, such as tris-hydroxy methylaminomethane (see U.S. Pat. No. 4,195,976).

It is, therefore, an object of the present invention to inhibit the accumulation of harmful carbonaceous material on the inner surfaces of vessels confining a heated hydrocarbon fluid.

Another object is to disperse the carbonaceous material formed during the preheating of a crude oil and thereby inhibit its accumulation on the various parts of the inner wall of the heat exchanger prior to its introduction into the distillation unit, e.g. a pipe still.

Yet another object is to reduce the amount of downtime in the operation of refinery heat exchangers and cracking units.

SUMMARY OF THE INVENTION

It has been discovered that introducing at least 0.0005 weight percent of macrocyclic polyamine having 4 to 6 nitrogens per molecule into a crude oil having a temperature of about 370° F. markedly reduced the tendency of said oil to deposit carbonaceous material of the inner wall of the vessel confining said oil when compared with untreated oil.

Therefore in accordance with this invention there is provided an oil stream in refinery operations which has been inhibited to prevent fouling of process equipment by incorporation of from 0.0005 to 0.025, preferably 0.0005 to 0.0025, weight percent of an oil soluble macrocyclic polyamine compound having the formula

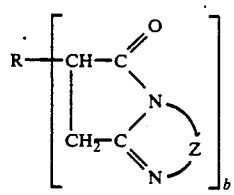

where R is a hydrocarbon having 20 to 15,000 carbon atoms, Z may be $—CH_2CH_2CH_2—$; $(CH_2CH_2CH_2NH)_nCH_2CH_2CH_2—$ where n is 1-6 or $(CH_2CH_2CH_2NH)_mCH_2CH_2(NH—CH_2CH_2CH_2)m'—$ wherein m+m' is 2-5.

In a preferred sense the objects of this invention are achieved with an antifoulant package comprising from 5 to 70, preferably 10 to 50, weight percent of an oil soluble macrocyclic polyamine compound having the formula

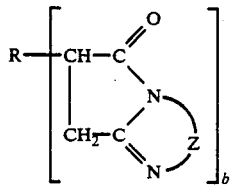

where R is a hydrocarbon having 20 to 15,000 carbon atoms, b may be 1-150 and Z may be $—CH_2CH_2CH_2—$; $(CH_2CH_2CH_2NH)_n—CH_2CH_2CH_2—$ where n is 1-6 or $(CH_2CH_2CH_2NH)_mCH_2CH_2—(NH—CH_2CH_2CH_2)m'—$ wherein m+m' is 2-5 in a hydrocarbon oil diluent and containing, if desired, dispersant(s), antioxidant(s) and mixtures thereof, said weight percent being based on the total weight of the package.

The method of the invention will be realized by introducing into a heated hydrocarbon fluid at least an antifouling amount of an oil soluble macrocyclic polyamine compound having the formula

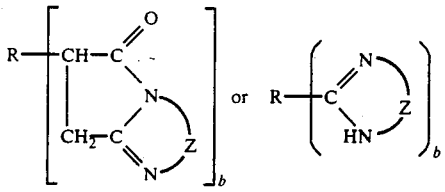

where R is a hydrocarbon having 2 to 15,000 carbon atoms, b may be 1–150 and Z may be $—CH_2CH_2CH_2—$; $(CH_2CH_2CH_2NH)_n—CH_2CH_2CH_2—$ where n is 1–6 or $(CH_2CH_2CH_2NH)_mCH_2CH_2(NH—CH_2CH_2CH_2)m'—$ wherein m+m' is 2–5, preferably introduced in a hydrocarbon oil diluent and if desired along with dispersant(s), anti-oxidant(s) and mixtures thereof.

DETAILED DESCRIPTION OF THE INVENTION

The macrocyclic polyamine required for the purposes of this invention is described in detail in the copending application Stanley J. Brois et al, Ser. No. 453143, filed Dec. 27, 1982.

In the interest of not unduly lengthening the present specification it is intended that the disclosure of the said Brois et al. application be considered as forming a part of the present specification.

In summary, application Ser. No. 453,143 deals with compositions of oil-soluble, macrocyclic polyamine compounds being the reaction product, in a cyclodehydration reaction, of a hydrocarbon substituted succinic anhydride with a poly 3-amino propyl amine compound, having 2 to 8 nitrogen atoms, the oil soluble macrocyclic polyamine compound being a member of the group of compounds represented by the following formulas, or mixtures of said compounds:

I

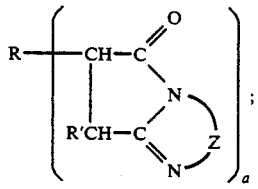

II

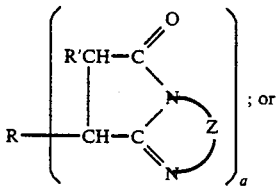

III

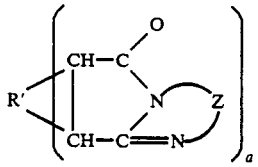

wherein R' is hydrogen or lower $C_1$–$C_{12}$ alkyl, R is a hydrocarbon substituent having 20 to 15,000 carbon atoms, R'' is a hydrocarbon substituent of 4 to 15,000 carbon atoms having two of its carbon atoms bonded to the alpha carbon atoms of the cyclodehydrated succinic anhydride moiety, Z may represent $—CH_2CH_2CH_2—$, $—(CH_2CH_2CH_2NH)_nCH_2CH_2CH_2—$ where n is 1–6 or $—(CH_2CH_2CH_2NH)_mCH_2(CH_2)p(NH—CH_2CH_2CH_2)m'—$ where m and m' are each at least 1 and m+m' is 2–5, p is 1–4 and a is an integer 1–20.

Formulas I and II above are meant only to represent different isomers which will form as result of formation of the hydrocarbon substituted succinic anhydride. A typical product will be a mixture of isomers such as about 50–90% of the Formula I syn-isomer and the balance the Formula II anti-isomer. Formula III would be illustrated by a Diels-Alder type reaction in the preparation of polyisobutenyl succinic anhydride from chlorinated polyisobutylene and malenic anhydride where two reactive sites are provided for bonding the polymer backbone to each of the alpha atoms of the anhydride moiety. Embodiment would be represented by a formula wherein Z is trimethylene and a is 1:

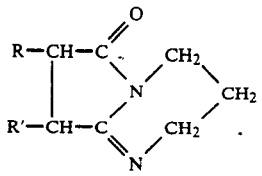

and this compound would therefore be derived from 1,3-propanediamine.

Larger macrocyclic structures can be represented by the structure below wherein Z is $—CH_2CH_2CH_2NHCH_2CH_2CH_2—$ and a is 1:

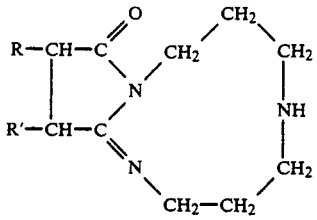

and in the next structure below, a is 1, and Z is a polyimino alkylene unit of the formula $—(CH_2)_3—NH—(CH_2)_3—NH—(CH_2)_3—NH(CH_2)_3NH—(CH_2)_3—$:

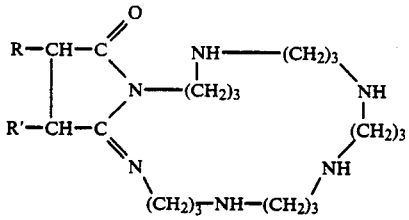

The variation of a between 1 and 20 is intended for numbers greater than 1 to represent multi-site macrocyclic polyamines, that is, those products derived from polyfunctionalized hydrocarbon succinic anhydrides having more than 1 succinic anhydride group per mole of hydrocarbon substituent. Usually, such as for ethylene-propylene copolymer substituted succinic anhydrides, the value of "a" may vary from about 1 to about 10. The preferred value is about 1 to 8, with multi-site products derived from ethylene propylene copolymers and terpolymers of $\overline{M}_n$ 10,000 to 200,000 being particularly preferred with a corresponding preferred value of a of from about 2 to 20, since these products have good viscosity modifying and/or antifoulant properties.

Other useful macrocyclic polyamine compounds may also be formed by reacting the same category of poly-(3-aminopropyl)amine reagents with a monocarboxylic acid to give macrocyclic compounds having the general formula:

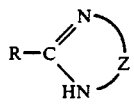

wherein R and Z are as described above. Similarly, useful macrocyclic polyamine compound may be prepared from polycarboxylic acids or polymers such as ethylene-propylene graft copolymer with acrylic acid or alternating copolymers of ethylene-acrylic acid or vinyl ether-acrylic acid in accordance with the cyclodehydration reaction process of the invention to give macrocyclic compounds which may be generalized as

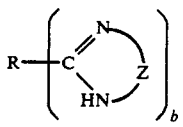

wherein b is an integer of 2 or more representing compounds derived from polycarboxylic acids having 2 or more reactive carboxylic groups. The upper limit of b is a value of about 150. R and Z are as previously defined.

These embodiments depend upon the use of polyamines having terminal 3-amino propyl groups including both simple diamines such as 1,3-propane diamines, 3,3'-imino-bis-propylamine, N,N-bis-(3-amino propyl-)ethylene diamine and higher oligomers such as pentapropylene hexamine. Further embodiments include polyamino propyl amines having C-substituents such as $C_{12}$–$C_{20}$ alkyl, $C_6$–$C_{10}$ aryl, hydroxyl, thio, cyano, ethoxy, polyoxyethylene and polyoxypropylene having a degree of polymerization of 2–10 and other compatible non-reactive functional groups, but N-substituted polyamines are not suitable reactants in preparing the macrocyclic compounds of this invention in a cyclodehydration reaction. Other amines not meeting these requirements, such as ethylene and 1,2-propylene amines will, upon aminolysis, give non-cyclic imide type products not within the scope of this invention as opposed to the macrocyclic structures utilized in accordance with the invention, the cyclic structure being the essential property for use in the process of the invention.

Suitable amines for the cyclodehydration reaction may be generalized by the formula $NH_2$—Z—$NH_2$, where Z is as described above. The carbon atoms may contain substituents as noted above but the nitrogen atoms must be either —NH— or —$NH_2$. Preferably Z is —$CH_2CH_2CH_2$, —$(CH_2CH_2CH_2NH)_mCH_2CH_2CH_2$— where n is 1–3 or $(CH_2CH_2CH_2NH)_m(CH_2CH_2)(NHCH_2CH_2CH_2)_{m'}$ where m and m' are as described above.

Formation of the macrocyclic and polyamine compounds proceeds by aminolysis of the hydrocarbyl substituted succinic anhydride, monocarboxylic acid or polycarboxylic acid using an inverse mode of addition. Such a process will avoid the formation of the non-cyclic, imide products or other products resulting from chain extension. The first step of the synthesis is to slowly add the succinic anhydride or mono- or polycarboxylic acid to the polyamine compound at relatively low temperatures, such as from room temperature, that is, about 20° C., up to about 150° C. in an inert hydrocarbon solvent, such as xylene, toluene, dichlorobenzene or a neutral paraffinic mineral oil. This inverse mode of addition is critical to form the 1:1 amic acid or amine carboxylate salt intermediate and inhibit or prevent formation of imide or amide non-cyclic final products. The reaction temperature during this inverse addition of hydrocarbon succinic anhydride or carboxylic acid should be as low as possible, preferably below 100° C., and the optimum temperature will vary somewhat depending on the reactivity and structure of the anhydride compound. The first phase is believed to be the formation of a 1:1 intermediate, and the temperature and rate of addition should be merely sufficient to promote this reaction. Thus at the beginning of the reaction a molar excess of amine relative to moles of succinic anhydride or carboxylic acid groups present is used to minimize bis-imide formation. The formation of an intermediate 1:1 amic acid salt is indicated by the disappearance of the succinic anhydride carbonyl bands in the infrared spectrum of the reaction mixture. The formation of the amine carboxylate intermediate is indicated by the appearance of a carbonyl band in the infrared spectrum of the product due to carboxylate ion formation.

The second step of the process, the cyclodehydration of the amic acid or amine carboxylate intermediate is effected at a temperature consistent with the reactivity of the intermediate salt, with suitable cyclodehydration temperatures ranging from 110° C.–250° C. Formation of the macrocyclic polyamine structure is indicated by cessation of evolution of water and by the maximization of the C=N absorption band at about the 6 micron range in the infrared spectrum of the reaction product.

It is critical to the cyclodehydration process that this inverse mode of addition be used to effect the aminolysis of the succinic anhydride or carboxylic acid. Thus the slow addition of hydrocarbon succinic anhydride or carboxylic acid to the well stirred polyamine, preferably in solution, maintained at about 20° to 150° C. maximizes the formation of the 1:1 intermediate salt which upon further heating at 110°–250° C. undergoes cyclodehydration to the desired macrocyclic polyamine product. In contrast to this, adding the polyamine to the hydrocarbon succinic anhydride, produces linear imide products.

The hydrocarbon substituted succinic anhydrides reacted with the poly(3-amino propyl) reagents or preformed cyclic amines in accordance with this invention are derived generally from oil soluble hydrocarbons comprising unbranched saturated or unsaturated hydrocarbon chains of at least 8, preferably at least 50 carbon atoms including both polymeric, oligomeric and non-polymeric aliphatic chains, particularly polymers of $C_2$–$C_5$ olefins. Preferable for use is the thermal polyisobutenyl succinic anhydride of Mn about 900 to 2,000 produced in the "ene" reaction by heating together polyisobutylene and maleic anhydride at about 200° C. although chlorinated polyisobutylene can be used as the precursor as well.

In another process embodiment macrocyclic and polycyclic polyamines can be prepared by condensing the hydrocarbon succinic anhydrides with macrocyclic polyamines (aza crown compounds) and polycyclic polyamines (aza polycycles) in an acylation reaction. Aza crown compounds useful herein are those having at least 2 NH groups and may be represented by the formula:

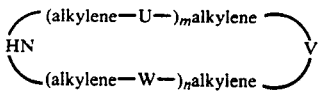

wherein U, V and W can be NH, S and/or O, n or m is an integer of 1 to about 4, alkylene is $C_2$–$C_4$, usually an ethylene or trimethylene group, and these aza crown compounds include macrocyclic polyamines (U=V=W=NH), polyether amines (U=W=O, V=NH, etc.) and polythioether amines (U=W=S, V=NH).

Examples within the scope of the foregoing formula are macrocyclic polyamines and their complexes having three to about eight nitrogen atoms, at least one, which is an NH group. Preferred are those having four nitrogen donors in cycles containing about 12 to 16 atoms. Examples of useful macrocyclic polyamines include 1,4,8,11-tetraazacyclotetradecane (cyclam), 1,4,7,10-tetrazacyclododecane, 1,4,7,10,13,16-hexaazacycloctadecane (hexacyclen).

Also suitable are mixed donor macrocyclic amines containing nitrogen-oxygen, nitrogen-sulfur, and nitrogen-oxygen-sulfur donor groups as depicted below which can be acylated to give useful lubricant additives.

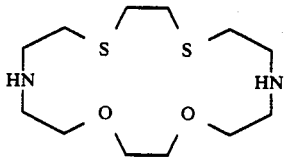

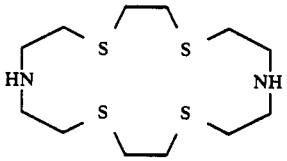

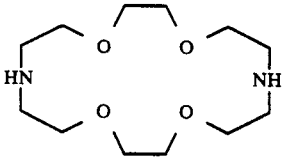

Also useful are azo polycyclic ring assemblies (aza polycycles) containing 2 to 3 rings having 5 to 6 atoms in the ring, including 3 or 4 nitrogen atoms at least one being an NH group, but preferably 2–3 NH groups per molecule are present, which compounds can be represented by the formulas:

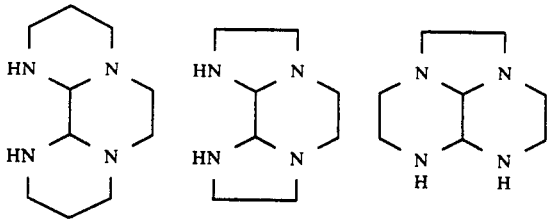

These amino compounds may be acylated by reacting at least a half-mole equivalent up to a 2 mole equivalent of the aforementioned hydrocarbon substituted succinic anhydrides.

Further embodiments reside in the formation of metal complexes and other post-treatment derivatives, e.g. borated derivatives, of the novel macrocyclic additives prepared in accordance with this invention. Suitable metal complexes may be formed in accordance with known techniques of employing a reactive metal ion species after the reaction of the polyamine and the hydrocarbyl anhydride compound. Complex-forming metal reactants include the nitrates, thiocyanates, halides, carboxylates, phosphates, thiophosphates, sulfates, and borates of transition metals such as iron, cobalt, nickel, copper, chromium, manganese, molybdenum, tungsten, ruthenium, palladium, platinum, cadmium, lead, silver, mercury, antimony and the like. Prior art disclosures of these complexing reactions may be found in U.S. Pat. No. 3,306,908 and U.S. Re. No. 26,433.

Post-treatment composition include reacting the macrocyclic additives with one or more post-reacting reagents, usually selected from the group consisting of boron oxide, boron oxide hydrate, boron halides, boron acids, sulfur, sulfur chlorides, phosphorous sulfides and oxides, carboxylic acid or anhydride acylating agents, epoxides and episulfides and acrylonitriles. The reaction of such post-treating agents with the macrocyclic polyamine compounds is carried out using procedures known in the art. For example, boration is accomplished in accordance with the teachings of U.S. Pat. No. 3,254,025 by treating the macrocyclic polyamine compound with a boron oxide, halide, ester or acid to provide about 0.1 to 1 atomic proportions of boron for each atomic proportion of nitrogen in the composition. Treatment is carried out by adding about 1–3 wt % of boron compound, preferably boric acid, and heating and stirring the reaction mixture at about 135° C. to 165° C. for 1 to 5 hours followed by nitrogen stripping and filtration, if desired. Mineral oil or inert organic solvents facilitate the process.

Specific examples of macrocyclic polyamines which are disclosed in detail in application Ser. No. 453,143 and which are useful as the macrocyclic polyamine derivative (MPD) herein are shown in Table I.

TABLE I

| Ex. No. of Ser. No. 453,143 | PIBSA[1] Reacted with the Polyamine | MPD % N |
|---|---|---|
| B7 | 4,7-diazadecane 1,10-diamine (DADD) | 1.98 |
| B8 | DADD | 1.57 |
| B9 | DADD | 1.83 |

TABLE I-continued

| Ex. No. of Ser. No. 453,143 | PIBSA[1] Reacted with the Polyamine | MPD % N |
|---|---|---|
| B12 | (TAOD mixture)[2] | 2.54 |

[1]PIBSA refers to polyisobutenyl succinic anhydride having a polyisobutenyl chain of 1300 $\overline{M}w$ as determined by vapor phase osmometry (VPO) of the polyisobutylene prior to its reaction with maleic anhydride and a saponification number of 65.
[2]Commercial TAOD is a product of BASF Wyandotte Corporation, Parsippany, NJ (BASF identifies this product as "$N_6$-amine mixture"). According to BASF's Technical Bulletin, commercial TAOD consists mainly (over 50%) of 4,8,11,15-tetraazaoctadecane-1,18-diamine (TAOD); additional components include higher and lower homologs. The total nitrogen content is ca 28.5%, comprising 12% primary, 15% secondary and 1.7% tertiary nitrogen.

Additional examples of macrocyclic polyamines useful for the purposes of this invention are as follows. Unless specified otherwise, as used herein all parts and percentages are by weight and based on the weight of the treated oil.

EXAMPLES 1-10

Five macrocyclics containing 4, 5 and 6 nitrogen atoms per molecule obtained from the reaction of polyisobutylene succinic anhydride (SAP number is 65 and a molecular weight of about 1400) and the appropriate polyamines, identified as PIBSA 4N, PIBSA 5N and PIBSA 6N respectively.

The value of the herein described method of preventing the accumulation of carbonaceous material in refinery cracking units was investigated by means of a laboratory test apparatus known as the Thermal Fouling Tester.

The Tester is a modification of the Alcor Jet Fuel Oxidation Tester which is specified in ASTM Vol. 25 D-3241. It is configured to allow measurement of the fluid temperature at the exit of the heat exchanger while the metal temperature of the heated tube is controlled. The test tube thus measures the change in temperature of a fluid which has been pumped across a heated surface. The outlet temperature is directly related to the heat transferred to the fluid. If fouling occurs, a deposit adheres to the heated surface and insulates a portion of the surface from the test fluid. The insulating deposit reduces the rate of heat transfer to the fluid and its temperature decreases. The rate of change in the fluid temperature is a measure of the rate of fouling.

The time over which temperature measurements are recorded was set at 3 hours. By doing this, the changes in temperatures of several fluids can be used as a measure of their relative fouling tendencies.

When testing the activity of additives, the conditions are set so as to allow the fluid temperature at the outlet to drop about 50° F. during the test period. Except for the most unstable fluids, the temperature of the heated surface is normally significantly higher than that in the field application in order to effect fouling within the time of the test. Because of this acceleration of the test, the results are qualitative.

The results in Table II show the beneficial effects of a macrocyclic polyamine in inhibiting the accumulation of carbonaceous material on a preheater tube as indicated by the change in final temperature (ΔT) in °F. of the fluid as fouling deposits build up on the surface of the heat source over which the fluid flows. The larger the (ΔT) the greater the amount of fouling.

TABLE II

| Additive | Crude | Dosage (ppm) | Tube Temp (°F.) | (ΔT) °F. | Average % Fouling Reduction |
|---|---|---|---|---|---|
| None | A | — | 750 | 39-50 | — |
| PIBSA N6 | A | 83 | 750 | 17-20 | 60 |
| None | B | — | 800 | 71-84 | — |
| PIBSA N6 | B | 90 | 800 | 32-70 | 28 |
| PIBSA N5 | B | 90 | 800 | 62-74 | 11 |
| PIBSA N4 | B | 90 | 800 | 54-60 | 28 |
| PIBSA N4 | B | 90 | 800 | 44-64 | 30 |
| PIBSA N6 | B | 90 | 800 | 54-70 | 20 |
| None | C | — | 700 | 44-48 | — |
| PIBSA N5 | C | 100 | 700 | 32-36 | 26 |

Crudes A and B were two different crude blends of primarily West Texas Sour Crudes.
Crude C is a crude blend primarily of a West Texas Invermediate and light Louisiana Sweet.

One or more other additives having useful anti-foulant activity can be used in combination with macrocyclic polyamines described herein to provide reduction of fouling. Suitable additives include dispersants and anti-oxidants.

Representative oil soluble dispersants include the acylated nitrogen compounds such as polyisobutylene succinimides of polyalkylene polyamines (see U.S. Pat. No. 3,272,746) and their borated derivatives, esters of long chain dicarboxylic acids such as polyisobutenylsuccinic anhydride esterified with a polyol, such as pentaerythritol (see U.S. Pat. No. 3,381,002) or with a hydroxy amine, such as ethanolamine (see U.S. Pat. No. 3,272,746), mono and bis oxazolines of polyisobutenyl succinic anhydride (see U.S. Pat. No. 4,049,564) lactone esters reaction products of hydrocarbon substituted lactone carboxylic acid with polyols (see U.S. Pat. No. 4,123,373), thio-bis-acyl esters (see U.S. Pat. No. 4,417,062), sulfonates and sulfonic acids such as $C_{28}$-$C_{32}$ alkyl benzene sulfonic acid (see U.S. Pat. No. 4,182,613) and thio-bis-oxazolines (see U.S. Pat. No. 4,292,184).

Representative oil-soluble anti-oxidants are the zinc dihydrocarbyl-substituted dithiophosphates such as zinc dinonylphenyldithiophosphate (see U.S. Pat. No. 4,085,053), nonylphenol sulfide, the known class of hindered amines such as N-phenylnaphthylamine, tris-(alkylaryl)phosphite, trithiones produced by the reaction of an olefin such as diisobutylene and triisobutylene with elemental sulfur, tert-octylphenol sulfide, 4,4'-methylene bis(2,6-ditert-butyl phenol), fatty acid thiocyanates such as lauroyl thiocyanate and stearoyl thiocyanate (see U.S. Pat. No. 2,168,674) and thiocarbamyl derivatives (see U.S. Pat. No. 4,303,539).

Generally the macrocyclic polyamine additive mixture of the package will contain in concentration of said macrocyclic polyamine from 5 to 70, preferably 10 to 30, parts by weight of said macrocyclic polyamine based on the total weight of the package with additional dispersant(s) and antioxidant(s) as desired. Broadly the weight ratio of macrocyclic polyamine to the other additive(s) possessing antifoulant activity will range from 1:9 to 9:1, preferably 1:4 to 4:1 in the mixture which along with diluent constitutes the package.

The invention in its broader aspect is not limited to the specific details shown and described and departures may be made from such details without departing from the principles of the invention and without sacrificing its chief advantages.

What is claimed is:

1. A method for inhibiting the accumulation of carbonaceous material on the inner surface of process equipment confining heated hydrocarbon oil comprising the step of dissolving at least 0.0005 weight percent of an oil soluble macrocyclic polyamine having 2 to 8 nitrogen atoms per molecule in said oil, said weight percent based on the weight of said oil.

2. A method for inhibiting the accumulation of carbonaceous material in a refinery unit during the passage of a hydrocarbon feed stock therethrough which comprises dissolving in said feed stock at least an anti-fouling amount of an oil-soluble macrocyclic polyamine compound having the formula:

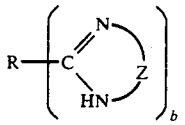

wherein R is a hydrocarbon having 2 to 15,000 carbon atoms, b is 1-150, Z is $-CH_2CH_2CH_2-$; $(CH_2CH_2CH_2NH)_n-CH_2CH_2CH_2-$ wherein n is 1-6 or $(CH_2CH_2CH_2NH)_mCH_2CH_2(NH-CH_2CH_2CH_2)_{m'}-$ wherein m+m' is 2-5.

3. The method of claim 2 wherein the refinery unit is a preheating unit.

4. A method in accordance with claim 3 further characterized in that at least about 0.0005 weight percent of said macrocyclic polyamine is dissolved in said hydrocarbon feed stock, said weight percent based on the weight of said feed stock.

5. A method in accordance with claim 3 further characterized in that R contains from about 60 to about 120 carbon atoms.

6. A method in accordance with claim 4 wherein there is at least one other additive possessing anti-foulant activity in addition to said macrocyclic polyamine.

7. The method according to claim 2 wherein said polyamine compound has been post-treated with a complex-forming metal such as germanium, tin or antimony or boron or phosphorous reactant.

8. The method according to claim 7 wherein there is also present at least one other additive possessing anti-foulant activity in addition to said polyamine compound.

9. A method for inhibiting the accumulation of carbonaceous material in a refinery preheating unit during the passage of a hydrocarbon feed stock therethrough which comprises dissolving in said feed stock from about 0.0005 to about 0.0025 weight percent of an oil-soluble polycyclic polyamine compound being the acylated reaction product of at least a half-mole equivalent up to a 2 mole equivalent of a hydrocarbon succinic anhydride or carboxylic acid having 8 to 15,000 carbon atoms condensed with an aza polycyclic ring compound containing 2 to 3 rings having 5 or 6 atoms per ring including 3 to 4 nitrogen atoms at least one of which is an NH group at a temperature of from 110° to 250° C., said weight percent based on the weight of said feedstock.

10. A process according to claim 9 wherein said hydrocarbon succinic acid anhydride is polyisobutenyl succinic anhydride having a Mw of 1300 and said aza polycyclic ring compound is 4,7-diazadecane-1,10-diamine.

11. A process according to claim 9 wherein said hydrocarbon succinic acid anhydride is polyisobutenyl succinic anhydride having a $\overline{M}w$ of 1300 and said aza polycyclic ring compound is 4,8,11,15-tetraazaoctadecane-1,18-diamine.

* * * * *